US005103203A

United States Patent [19]

Huber

[11] Patent Number: 5,103,203

[45] Date of Patent: Apr. 7, 1992

[54] OIL IMMERSIBLE CURRENT LIMITING FUSE

[75] Inventor: William J. Huber, Waukesha, Wis.

[73] Assignee: Combined Technologies Inc., Brookfield, Wis.

[21] Appl. No.: 669,770

[22] Filed: Mar. 15, 1991

[51] Int. Cl.[5] ..... H01H 85/143; H01H 85/02

[52] U.S. Cl. ..... 337/248; 337/205; 337/252

[58] Field of Search ..... 337/248, 251, 252, 253, 337/268, 203, 204, 205, 158, 159, 160, 161, 162

[56] References Cited

U.S. PATENT DOCUMENTS

| | | | |
|---|---|---|---|
| 2,172,226 | 9/1939 | Smith | 337/248 |
| 4,158,187 | 6/1979 | Perreault | 337/252 |
| 4,346,362 | 8/1982 | Feenan et al. | 337/248 |
| 4,818,967 | 4/1989 | Mikulecky | 337/204 |

*Primary Examiner*—Harold Broome

*Attorney, Agent, or Firm*—Foley & Lardner

[57] ABSTRACT

A current limiting oil immersible fuse including a tubular housing having a resilient elastomeric cap sealed to each end of the housing, an end cap independently mounted on each end of the housing and overlying the resilient elastomeric cap and a fuse assembly supported in the housing by the end caps.

9 Claims, 1 Drawing Sheet

OIL IMMERSIBLE CURRENT LIMITING FUSE

FIELD OF THE INVENTION

The present invention relates to current limiting fuses of the type used under oil in transformers and more particularly to a seal assembly for the housing of the current limiting fuse.

BACKGROUND OF THE INVENTION

Current limiting fuses are used to interrupt current in oil filled transformers under fault current conditions. In order for the fuse to be immersible in oil, the housing must be provided with an absolute seal which will last for the life of the transformer which can be 10–20 years. The fuse must also be able to function at the full operating temperature range of the transformer which could be −30° C. to a maximum of 140° C.

Current limiting fuses generally consist of a cylindrical housing or tube which is capped off at each end by an end cap. A fusible element is positioned in the tube and connected to each end cap. The tube is filled with a granular filler material, such as silica sand. The filler material must have a high dielectric characteristic to prevent tracking when the fuse operates to clear the fault current otherwise the fuse would fail. It is essential, therefore, that no external contaminating material be allowed to enter the fuse. Fuses submerged in liquid material such as oil in transformers and switchgear must be provided with a seal which will prevent ingress of liquid into the fuse. One of the main problems with designing seals for under oil fuses is the difference between the temperature of the oil and the internal temperature of the fuse generated by the load current flowing through the fuse element which can cause dramatic changes in the characteristics of the materials which make up the fuse.

Fuses generally use a fiberglass/epoxy resin or a pyrex glass tube with end caps mounted on each end. The end caps are generally sealed to the tube by strong adhesives and in some instances an elastomeric part is added such as an 0-ring. The problem which has been confronted by the fuse designer is the difference in the temperature co-efficient of expansion of the metal end caps and the fiberglass tube. As the fuse is subjected to changes in temperature, the metal caps will expand and contract with respect to the fuse causing the seal to leak.

SUMMARY OF THE INVENTION

The current limiting fuse of the present invention achieves an oil immersible capability through a unique elastomeric cap which is provided at each end of the fuse housing to seal the fuse assembly in the fuse tube independently from the end caps. The tube is ground down on each end to form an inner flange to which the elastomeric caps are adhesively bonded. The elastomeric caps completely seal the ends of the fuse tube and are unaffected by the temperature excursions of the fuse. The elastomeric material will flex with the fuse tube thus providing a long life for the fuse.

The current limiting fuse advantageously provides an improved seal for a current limiting fuse which is simple in application and effectively increases the life of the fuse.

The elastomeric end caps which close the ends of the dielectric tube for the fuse element advantageously provide a simple yet effective method for permanently sealing the fuse element in the tube.

Other principal features and advantages of the invention will become apparent to those skilled in the art upon review of the following drawings, the detailed description and the appended claims.

DETAILED DESCRIPTION OF THE DRAWINGS

Figure 1:
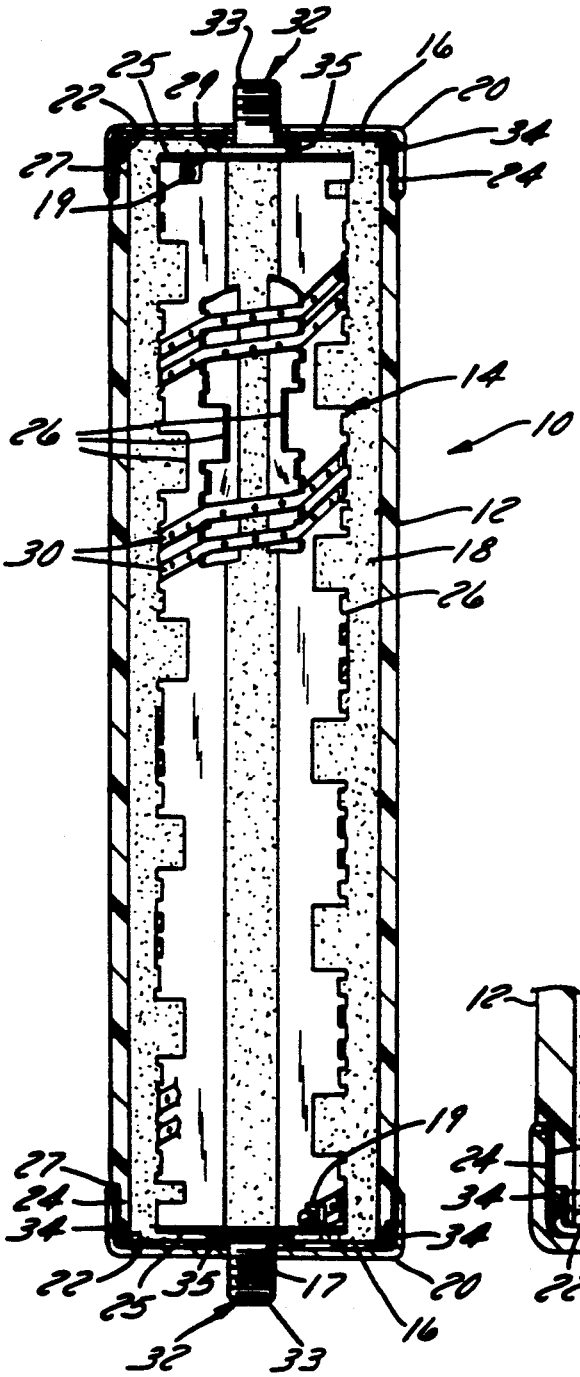
FIG. 1 is a sectional elevation view of the fuse according to the present invention.
Figure 2:
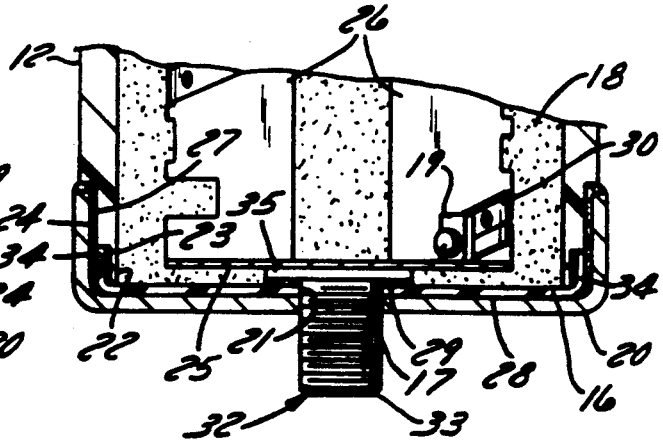
FIG. 2 is an enlarged view of one end of the fuse showing the elastomeric cap mounted on the end of the fuse housing and enclosed by the end cap.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology, employed herein is for the purposes of description and should not be regarded as limiting.

DETAILED DESCRIPTION OF THE PREFERRED EMBODIMENTS

The oil immersible current limiting fuse 10 of the present invention generally includes a dielectric cylindrically shaped tube cap housing 12. A fuse assembly 14 is sealed within the housing 12 by means of elastomeric caps 16 provided on each end of the housing 12. The housing 12 is filled with a granular arc extinguishing material 18 such as silicon sand as is generally understood in the art. An end cap 20 is provided at each end of the dielectric housing 12 to enclose the elastomeric caps 16. In accordance with the present invention, elastomeric end caps 16 are mounted on each end of the housing 12 to permanently seal the fuse assembly 14 in the housing 12. The housing 12 is ground at each end to provide a first or inner flange 22 for the elastomeric caps 16 and a second or outer flange 24 for the end caps 20.

As noted in the drawing, the fuse assembly 14 includes a number of dielectric plates 26 having a conductive plate 25 mounted on each end. Fuse elements 30 are spirally wound around the dielectric plates 26 and are connected to tabs 19 provided on each of the conductive plates 25. An end boss 32 is secured to each of the end plates 30 to provide an electrical connection to the ends of the fuse element 30. In this regard, each end boss 32 includes a threaded stud 33 having a flange 35 at one end.

The elastomeric end caps 16 are each molded in one piece having a flat center portion 28 and a flange 34 around the outer edges of the center portion 28. A hole 21 is provided in the center of the center portion 28. The end caps 16 are secured to the first or inner flange 22 on the end of the fuse tube 12 by means of an adhesive 23 and to the end boss 32 on the fuse assembly 14 by an adhesive 29. The end caps 20 include an opening 17 which is aligned with the boss 32 or the end of fuse assembly 14. The flange of the end cap 20 is secured to the second or outer flange 24 by an epoxy resin adhesive 27. With this arrangement, the seal for the elastomeric cap 16 is completely independent cf the end caps 20 and will hold the flange 34 in tight engagement with the flange 22 during temperature excursions within the fuse since the elastomeric material will flex with the housing.

The fuse 10 is assembled by initially applying the adhesive 23 to the flange 22 on one end of the housing 12. The flange 34 of the elastomeric cap 16 is mounted on the flange 22 at the end of the housing 12 and secured thereto by the adhesive 23. Epoxy resin adhesive is then applied to the outer flange 24 on the same end of the housing and the metal end cap 20 mounted on the flange 24 of the housing 12. The end cap 20 which may be made of a metallic, plastic or some other material will overlie the elastomeric cap 16. Adhesive 29 is applied to the junction of the stud 33 with the flange 35 on boss 32. The fuse assembly 14 is inserted into the housing with the boss 32 centered in the opening 21 in the resilient end cap 16 and the opening 17 in metal end cap 20. The adhesive 29 will seal the elastomeric end cap 16 to the junction of the flange 35 with the stud 33. The open end of the housing 12 is turned upward and filled with the granular dielectric material 18. Adhesives are applied to the flange 22 at the other end of the housing and to the boss 32. The opening 21 in the resilient end cap 16 is centered on the boss and the flange 34 sealed to the flange 22. Epoxy resin is then applied to the flange 24 and the end cap 20 mounted on the end of the housing 12.

Thus, it should be apparent that there has been provided in accordance with the present invention an oil immersible current limiting fuse that fully satisfies the aims and advantages set forth above. Although the invention has been described in conjunction with specific embodiments thereof, it is evident that many alternatives, modifications and variations will be apparent to those skilled in the art. Accordingly, it is intended to embrace al' such alternatives, modifications and variations that fall within the spirit and broad scope of the appended claims.

The embodiments of the invention in which an exclusive property or privilege is claimed are defined as follows:

1. A current limiting oil immersible fuse comprising a tubular housing, a resilient elastomeric cap sealed to each end of said housing, an end cap independently mounted on each end of said housing and overlying said resilient elastomeric cap, and a fuse assembly mounted in said housing and supported by said end caps.

2. A current limiting fuse comprising:

a cylindrical housing, a fuse assembly mounted in said housing, said fuse assembly including an electrically conductive plate at each end, a fuse element interconnecting said plates, and a threaded boss mounted on each plate, an elastomeric cap mounted on each end of said housing, said caps being sealed to said housing and to said boss, and an end cap mounted on each end of said housing.

3. The current limiting fuse according to claim 2 wherein said housing includes a first and second flange at each end, said elastomeric cap being sealed to said first flange and said end cap being secured to said second flange.

4. A sealed current limiting oil immersible fuse comprising:

a housing having an opening at each end and an inner flange proximate each said opening, a fuse assembly in said housing, a granular arc extinguishing filler filling said housing, means for sealing the ends of said housing and supporting said fuse assembly, said means comprising an elastomeric cap mounted on said inner flange at each end of said housing, and an end cap mounted on each end of said housing.

5. The fuse according to claim 4 wherein said housing further includes an outer flange proximate said inner flange, said end cap being mounted to said outer flange such that said elastomeric caps are mounted on each end of said housing inside of said end caps.

6. The current limiting oil immersible fuse according to claim 1 wherein said housing includes a first flange at each end and said resilient elastomeric cap is sealed to said first flange.

7. The current limiting oil immersible fuse according to claim 6 wherein said housing further includes a second flange at each end and said end cap is sealed to said second flange.

8. The current limiting oil immersible fuse according to claim 7 wherein said second flange has a diameter greater than said first flange.

9. A current limiting oil immersible fuse of the type having a housing and a fuse assembly supported in the housing by electrically conductive end caps mounted on each end of said housing, the improvement comprising an elastomeric cap sealed to each end of the housing interiorly of and independent of the end caps, such that said elastomeric caps are held in tight engagement with said housing during temperature excursions within the fuse.

* * * * *